US007482740B2

(12) United States Patent
Niimi

(10) Patent No.: US 7,482,740 B2
(45) Date of Patent: Jan. 27, 2009

(54) ELECTRODE UNIT OF EXTREME ULTRAVIOLET GENERATOR

(75) Inventor: Gota Niimi, Shimizu (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 432 days.

(21) Appl. No.: 11/436,694

(22) Filed: May 19, 2006

(65) Prior Publication Data

US 2006/0261721 A1 Nov. 23, 2006

(30) Foreign Application Priority Data

May 20, 2005 (JP) ..... 2005-147782

(51) Int. Cl.
*H01J 1/00* (2006.01)

(52) U.S. Cl. ..... 313/326

(58) Field of Classification Search ..... 313/326, 313/30, 39, 231.31

See application file for complete search history.

(56) References Cited

U.S. PATENT DOCUMENTS 3,390,292 A * 6/1968 Perugini ..... 313/23
6,894,298 B2 5/2005 Ahmad et al.

FOREIGN PATENT DOCUMENTS

JP 11-190787 A 7/1999
JP 2001-293576 A 10/2001
JP 2003-218025 A 7/2003

* cited by examiner

*Primary Examiner*—Vip Patel
(74) *Attorney, Agent, or Firm*—Rader, Fishman & Grauer, PLLC

(57) ABSTRACT

An electrode unit of an extreme ultraviolet radiation generator comprise a breakdown voltage impression electrode, a ground electrode, an insulator provided in contact with the breakdown voltage impression electrode and the ground electrode in which plasma is generated between the discharge electrodes thereby emitting extreme ultraviolet radiation from the generated plasma, wherein at least one of the breakdown voltage impression electrode and the ground electrode includes a cooling portion which is made of copper, aluminum, or a material which contains copper, aluminum, or combination thereof as a main component and in which a passage through which a coolant passes is formed, and a discharge portion which is provided in close contact with a surface of the cooling portion, and which is made of any one of tungsten, tantalum, rhenium, molybdenum, and an alloy thereof as the a main component.

9 Claims, 7 Drawing Sheets

FIG. 1A
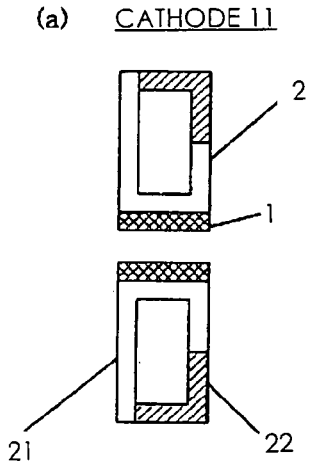
FIG. 1B
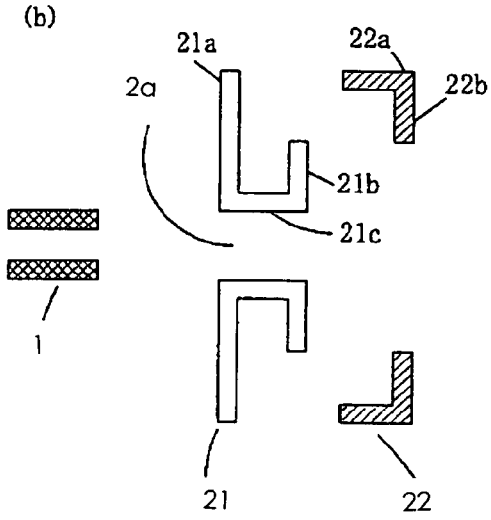
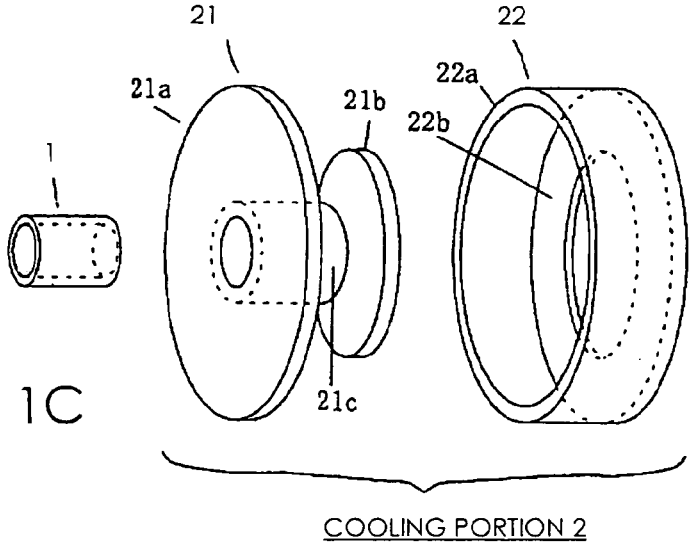
FIG. 1C

FIG. 2A
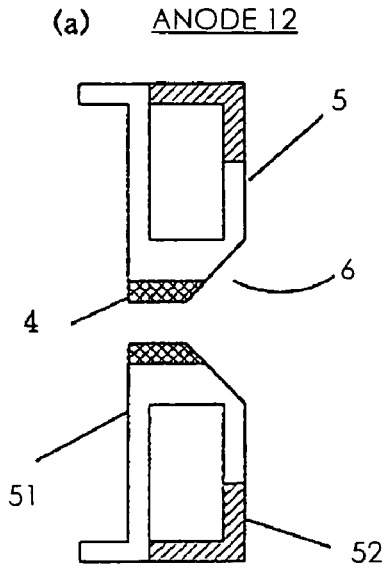
FIG. 2B
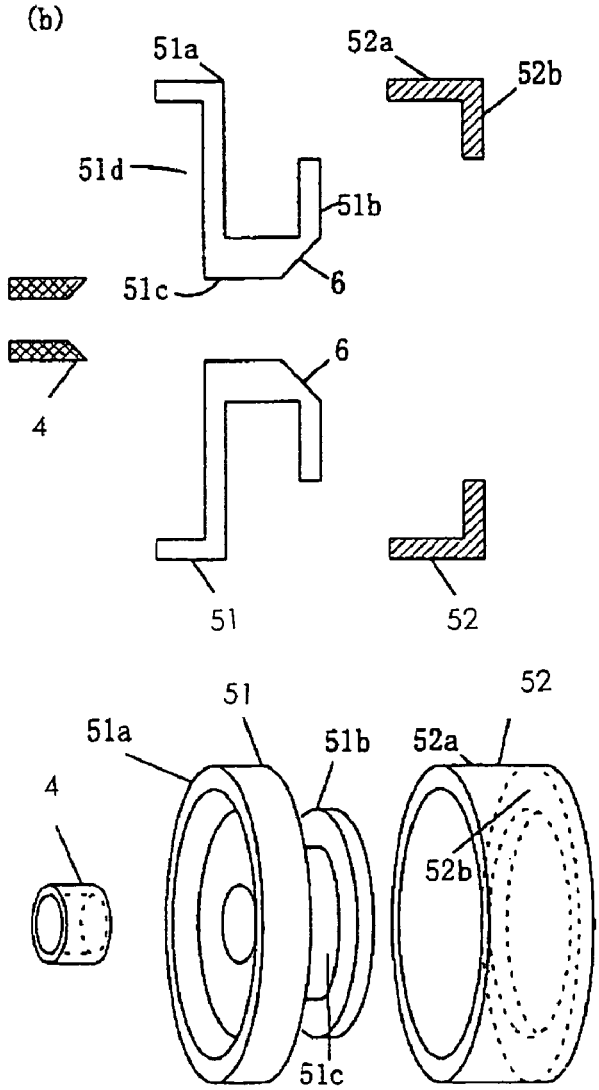
FIG. 2 C

ELECTRODE UNIT OF EXTREME ULTRAVIOLET GENERATOR

RELATED APPLICATION

The disclosure of Japanese Patent Application No. 2005-147782, filed May 20, 2005, including the specification, claims and drawings, is incorporated herein by reference in its entirety.

FIELD

The present invention relates to the structure of an electrode unit of an extreme ultraviolet radiation generator for generating extreme ultraviolet radiation according to gas discharge.

BACKGROUND

For the micro-fabrication of semiconductor integrated circuits, radiant rays having a shorter wavelength are required for an exposure (lithography). Light source devices which emit light having a wavelength of 11 to 14 nm called extreme ultraviolet radiation (hereinafter referred to as EUV radiation) are being developed. Among methods of generating the EUV radiation, there is a method of generating high temperature and high density plasma by discharge so as to emit EUV radiation. As an example of an apparatus to which the method is applied, there is an apparatus disclosed in Japanese Unexamined Patent Application Publication No. 2003-218025.

FIG. 7 shows a schematic view of an extreme ultraviolet radiation generator (hereinafter referred to as EUV radiation generator) which emits EUV radiation from plasma.

A ring-shaped first main electrode 11 (breakdown voltage impression electrode: cathode), and a second main electrode 12 (ground electrode: anode) are disposed so as to hold an insulator 13 therebetween. In a high temperature and high density plasma generating space 10, plasma is generated. The diameters of holes of the rings are about ϕ5 to 20 mm.

A chamber 14 which is a discharge container, is divided into a first container 14*a* on the side of the cathode, and a second container 14*b* on the side of the anode, which are separated and insulated by the insulator 13. For example, an Xenon (Xe) gas which is discharge gas, is introduced from an gas inlet 14*c* of the first container 14*a* to which a gas supply unit 20 is connected, and is discharged into a gas discharge unit (not shown) connected to the second container 14*b* from a gas outlet 14*d*.

The pressure of the high temperature and high density plasma generating space 10 is adjusted to 1 to 20 Pa by a vacuum pump connected to the second container 14*b*.

As described above, the second main electrode (anode) 12 is grounded, and a breakdown voltage of about −5 kV to −20 kV is applied to the first main electrode (cathode) 11 from a high voltage pulse generating unit 21. If the discharge gas, such as Xenon (Xe), is allowed to flow between the two electrodes, high temperature and high density plasma discharge is caused at 1 to 10 kHz inside the rings of the electrodes 11 and 12, and EUV radiation having a wavelength of 13.5 nm is emitted from the plasma. The emitted EUV radiation is led to a radiation-emitting portion 16 by collector optics unit 15 (EUV collector optics) provided in the second container 14*b*.

The reason why the second main electrode (anode) 12 is grounded is to prevent electric discharge from occurring between optical components of the collector optics system 15 (EUV collector optics) provided adjacent to the second main electrode 12. The optical components are attached to a chamber container and are at the ground potential along with the container.

SUMMARY

In the above extreme ultraviolet radiation generator, during discharge, the breakdown voltage impression electrode (cathode) and the ground electrode (anode) are exposed to the plasma so as to rise to an extraordinary high temperature. Therefore, a high melting point material like tungsten is used for these electrodes or the electrodes is cooled by a coolant.

The Japanese Unexamined Patent Application No. 2003-218025 also discloses a structure in which a rib for heat dissipation is formed on the periphery of each electrode case, and a coolant is supplied between the ribs from a coolant container to cool down these electrodes.

However, when electrodes are actually fabricated, there are problems as set forth below.

(i) For example, if a whole electrode is made of high melting point material like tungsten, machining will be difficult and it is very expensive.

(ii) Many of high melting point materials generally have high hardness. For example, if the Young's modulus that is the standard of hardness is set to 1 for aluminum, that of copper is 1.7, that of iron is about 3.2, and that of tungsten is about 5.6. Therefore, not only the formation of the rib for heat dissipation as disclosed in the above publication, but also processing of a flow passage for allowing cooling water to pass therethrough becomes difficult.

(iii) Meanwhile, if the material which is easy to machine, for example, copper, is used, although its heat conductivity is also good so that cooling efficiency also becomes good, since the material with easy machinability has in general a low melting point, the material melts immediately after being exposed to high temperature and high density plasma.

As described above, since the electrode portion of the extreme ultraviolet radiation generator is exposed to the plasma and rises to an extraordinary high temperature, the electrode portion is required to have a structure which can be cooled, using a high melting-point material, so that it is very difficult to manufacture such an electrode, and it is expensive.

According to an embodiment of the present invention, high melting point material is used for the electrode structure that rises to a high temperature, and further, a portion for cooling the electrode unit can be easily machined.

(1) Further, according to an embodiment of the present invention, each of a discharging electrode and a ground electrode comprises two portions, i.e., a discharge portion directly exposed to plasma, and a cooling portion which is not directly exposed to plasma. The discharging electrode and the ground electrode, each of which has the cooling portion, are brought into close contact with and attached to both sides of an insulator.

According to an embodiments, the cooling portion may be formed of copper, aluminum, or a material which contains at least one of them as a main component and has both easy machinability and good thermal conductivity, in which a coolant passage through which a coolant passes is formed. The discharge portion is formed of tungsten, tantalum, rhenium, molybdenum, or an alloy that contains at least one of them as a main component, that is material having a high melting point.

(2) Furthermore, according to an embodiment of the present invention, the ground electrode and the insulator may be formed in the shape of a ring, respectively, and may be disposed on the same axis. Moreover, the discharge portion may be formed in the shape of a ring, and provided on the side of the high temperature and high density plasma generating space. An outer wall of the ring-shaped discharge portion may be brought into close contact with an inner wall of the ring-shaped cooling portion of the ground electrode.

(3) Further, the cooling portion may be made from two or more members, in which a flow passage through which a coolant passes is formed. That is, the cooling portion may be made from a first member and a second member. The first member may have two disc-like members, which are different in diameter, and each of which has a hole at the center. The two disc-like members may be connected to both open ends of a cylindrical member, respectively. The inner diameters of the circular holes of the disc-like members and the inner diameter of the cylindrical member may be made equal to the outer diameter of the discharge portion, and an axis passing through the centers of the two disc-like members coincides with the axis of the cylindrical member.

Moreover, the second member may have a configuration in which a ring-shaped member and a disc-like member are connected to each other. The ring-shaped member may have the same diameter as that of one of the disc-like members of the first member, and the above disc-like member may be provided so as to cover one open end of the ring-shaped member and have a circular hole at the center, into which the other disc-like member of the first member fits.

Also, a ring-shaped cooling portion which has an annular passage serving as a cooling water passage therein may be constructed by aligning and joining the first member and the second member so that one of the disc-like members of the first member may face the ring-shaped member of the second member and the other disc-like member of the second member may fit into the hole of the disc-like member of the second member.

The following effects can be acquired from the above embodiments.

(1) Since part of the electrode to be exposed to high temperature and high density plasma (discharge portion) may be made of tungsten, tantalum, rhenium, molybdenum, or an alloy that contains at least one of them as a main component, that is high melting point material, it is possible to prevent the electrode from melting.

Meanwhile, since part of the electrode which is not directly exposed to high temperature and high density plasma (cooling portion) may be made of copper, aluminum, or material which contains at least one of them as a main component and has both easy machinability and good thermal conductivity, in which machining for allowing cooling water (coolant) to pass therethrough can be performed easily, and the discharge portion in close contact with the surface thereof can also be cooled efficiently.

(2) Since the electrode having the above cooling portions respectively may be brought into close contact with both sides of the insulator, the insulator can also be cooled efficiently.

(3) By constructing the cooling portion by combinations of a plurality of members, a flow passage for allowing cooling water to flow therethrough can be formed easily.

BRIEF DESCRIPTION OF THE DRAWINGS

Other features and advantages of the present electrode will be apparent from the ensuing description, taken in conjunction with the accompanying drawings, in which:

FIGS. 1A-1C are views showing a configuration of a discharge voltage impression electrode (cathode) according to an embodiment of the invention;

FIGS. 2A-2C are views showing a configuration of a ground electrode (anode) according to the embodiment of the invention;

DETAILED DESCRIPTION OF THE INVENTION

Figure 3A:
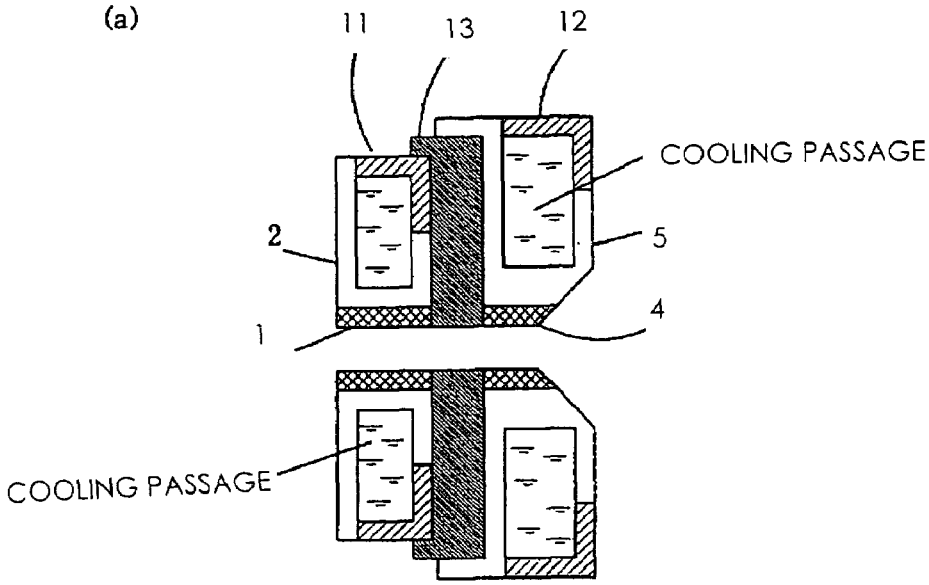
FIGS. 3A and 3B are views showing a basic configuration of an electrode unit according to the embodiment of the invention.

While the claims are not limited to the illustrated embodiments, an appreciation of various aspects of the electrode is best gained through a discussion of various examples thereof. Hereinafter, a schematic structure of an electrode of an EUV radiation will be described below.

FIGS. 1A, 1B and 1C are views showing a breakdown voltage impression electrode (hereinafter referred to as a cathode) which applies a breakdown voltage. FIG. 1A shows a cross-sectional view of the assembled cathode 11, and FIGS. 1B and 1C are exploded views thereof.

As shown in the figure, the cathode 11 is made up of a ring-shaped discharge portion 1 and a ring-shaped cooling portion 2.

The discharge portion 1 is made of tungsten, antalum, rhenium, molybdenum, or an alloy that contains at least one of them as a main component, that is a high melting point material. Tungsten is used in this embodiment. As shown in the figure, since the discharge portion 1 has a simple cylindrical shape without concave or convex portions, the machining thereof is possible even if it is somewhat hard.

The cooling portion 2 is made of copper, aluminum, or material which contains at least one of them as a main component and has both easy machinability and good thermal conductivity. Although copper is used in this embodiment, aluminum and the like can also be used. Moreover, material in which a small amount of silver is mixed with copper can also be used.

The cooling portion 2 is formed by combining a first member 21 and a second member 22. The first member 21 has two disc-like members 21*a* and 21*b*, which are different in diameter. The disc-like members 21*a* and 21*b* have a circular hole, and are connected to open ends of a cylindrical member 21*c*, respectively, and an axis passing through the centers of the disc-like members 21*a* and 21*b* coincides with the axis of the cylindrical member 21*c*.

The diameters of the circular holes of the two disc-like members 21*a* and 21*b* and the inner diameter of a through-hole which is formed in the cylindrical member 21*c* are equal to one another, and this inner diameter of the through-hole is equal to the outer diameter of the cylindrical discharge portion 1.

The second member 22 has a ring-shaped member 22*a* and a disc-like member 22*b* which are connected to each other. Here, the ring-shaped member 22*a* has the same diameter as the disc-like member 21*a*, and the disc-like member 22*b* is provided so as to cover one of open ends of the ring-shaped member 22*a* and has a circular hole at the center, into which the first member 21*b* fits.

Although the first member 21 and the second member 22 are formed by joining a plurality of members together, respectively, they may formed integrally.

A ring-shaped cooling portion 2 which has an annular passage serving as a cooling water passage therein is defined by aligning and joining the first member 21 and the second member 22 so that the disc-like member 21*a* faces the ring-shaped member 22*a*, and the disc-like member 21*b* fits into the hole of the disc-like member 22*b*. The first member 21 and the second member 22 are joined together by, for example, silver brazed welding. In the figure, pipelines to the cooling portions are omitted.

Furthermore, the cathode 11 having the shape as shown in the cross-sectional view of FIG. 1A is formed by fitting the discharge portion 1 into a through-hole defined by the inner wall of the cooling portion 2, (that is, the through-hole of the first member 21).

The length in the axial direction of the through-hole provided at the center of the first member 21 is equal to the length in the axial direction of the discharge portion 1, and the inner surface of the through-hole of the first member 21 is covered with the discharge portion 1 by fitting the discharge portion 1 into the through-hole of the first member 21.

An outer wall of the discharge portion 1 is brought into close contact with the inner wall of the hole 2*a* of the cooling portion 2. There are methods, for bringing the discharge portion 1 into the inner wall of the hole 2*a* such as shrinkage fitting, silver brazing, press-fitting (for example, refer to Japanese Unexamined Patent Application Publication NO. 2001-293576), or direct bonding (for example, refer to Japanese Unexamined Patent Application Publication No. 11-190787).

As described above, the cooling portion 2 according to this embodiment is formed by using the ring-shaped member which has a through-hole at the center, into which the discharge portion 1 fits. The annular passage serving as a cooling water passage along the shape of the ring is formed inside the ring-shaped member. Also, the cathode according to this embodiment is formed by inserting the ring-shaped (cylindrical) discharge portion 1 into the hole 2*a* formed at the center of the cooling portion 2 and by bringing the discharge portion 1 into close contact with the inner surface of the through-hole and attaching the discharge portion 1 to the inner surface of the cooling portion 2.

FIGS. 2A, 2B, and 2C are views showing a schematic view of a ground electrode (hereinafter referred to as anode), FIG. 2A shows a cross-sectional view of an assembled anode 12, and FIGS. 2B and 2C are exploded views of the anode 12.

Similarly to the cathode 11, the anode 12 is formed of a ring-shaped discharge portion 4 and a ring-shaped cooling portion 5. However, since the EUV radiation generated from the high temperature and high density plasma caused by discharge are emitted from the anode side, a cutaway portion 6 (tapered portion) formed so as to fit along the divergence of radiation is provided so that the radiation may not be blocked.

In this embodiment, the material of the discharge portion 4 is tungsten and the material of the cooling portion 5 is copper. This is the same as the case of the cathode 11. Moreover, similarly to the cathode 11, the cooling portion 5 is formed in a ring shape by joining a plurality of members, i.e., a first member 51 and a second member 52, and an annular passage serving as a cooling water passage is formed inside the cooling portion.

Similarly to the cathode 11, the first member 51 has two disc-like members 51*a* and 51*b*, which are different in diameter, each of which has a circular hole at the center thereof. The two disc-like members are connected to open ends of a cylindrical member 51*c*, and axes passing through the centers of the disc-like members 51*a* and 51*b* respectively coincide with the axis of the cylindrical member 51*c*.

The diameters of the circular holes of the two disc-like members 51*a* and 51*b* and the inner diameter of a through-hole which passes through the cylindrical member 51*c* are approximately equal to each other. The inner diameter thereof is equal to the outer diameter of the cylindrical discharge portion 4.

In addition, a recessed portion 51*d* for allowing an insulator 13 described later to fit thereinto is formed in the disc-like member 51*a*, and the cutaway portion 6 is formed on the cylindrical member 51*c* on the disc-like member side thereof.

Similarly to the second member 22 of the cathode 11, the second member 52 has a ring-shaped member 52*a* and a disc-like member 52*b* which are connected to each other. Here, the ring-shaped member 52*a* has the same diameter as the disc-like member 51*a*. The disc-like member 52*b* is provided so as to cover one of an open end of the ring-shaped member 52*a* and has a circular hole at the center, into which the first member 51*b* of the first member 51 fits.

Although, in this embodiment, the first member 51 and the second member 52 are formed by joining a plurality of members together respectively, they may be formed integrally.

A ring-shaped cooling portion 5 which has an annular passage serving as a cooling water passage therein is formed by aligning the first member 51 with the second member 52 so that the disc-like member 51*a* faces the ring-shaped member 52*a*, and the disc-like member 51*b* fits into the hole of the disc-like member 52*b*. The first member 51 and the second member 52 are joined together by, for example, silver brazed welding, as mentioned above. In addition, similarly to the cathode 11, pipelines to the cooling portion are omitted in this drawing.

Furthermore, the anode 12 having the shape as shown in the cross-sectional view of FIG. 2A is formed by fitting the discharge portion 4 into a through-hole formed at the center of the cooling portion 5.

An outer wall of the discharge portion 4 and an inner wall of the through-hole of the cooling portion 5 are brought into close contact with each other by shrinkage fitting, silver brazing, press-fitting, direct bonding, etc. as mentioned above.

As described above, the cooling portion 5 according to this embodiment is formed by fitting a ring-shaped member having a through-hole at the center thereof, into the discharge portion 4. The annular passage serving as a cooling water passage along the shape of the ring is formed inside the ring-shaped member. Also, the anode according to this embodiment is formed by inserting the ring-shaped (cylindrical) discharge portion 4 into the through hole at the center of the cooling portion 5 and by bringing the discharge portion 4 into close contact with the inner surface of the through-hole and attaching the discharge portion to the inner surface.

Figure 3B:
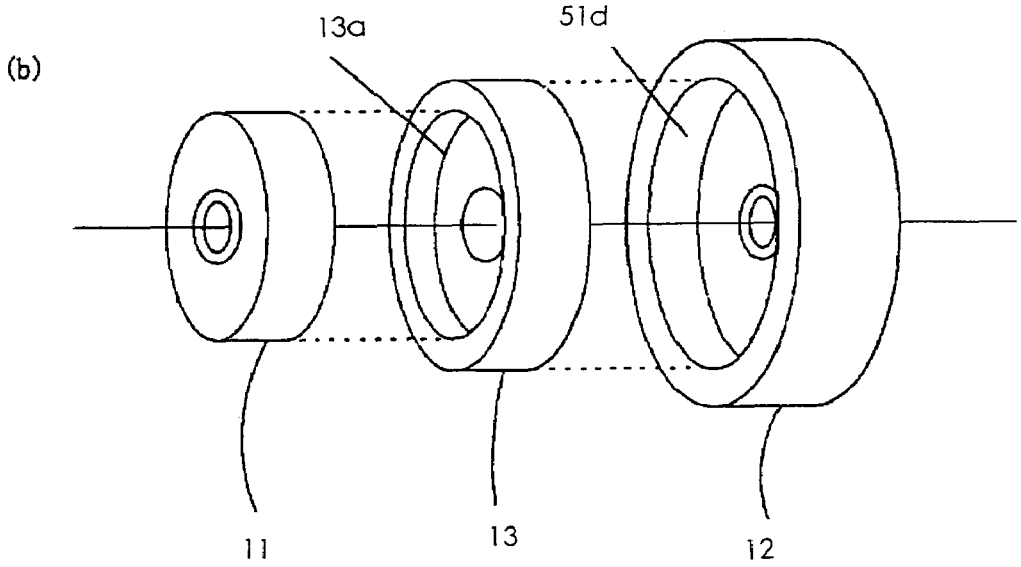

FIGS. 3A and 3B are views showing a basic configuration of an electrode unit. FIG. 3A shows a cross-section view of an assembled electrode, and FIG. 3B is an exploded view of members which form the electrode unit.

As shown in FIGS. 3A and 3B, the ring-shaped insulator 13 is sandwiched between the ring-shaped cathode 11 and the anode 12, which are made in the above manner. The cathode 11, the insulator 13, and the anode 12 are aligned on the same axis.

A recessed portion 13*a* for allowing the cathode 11 to fit thereinto is formed in a surface of the insulator 13. The cathode 11 is fitted into the recessed portion 13*a* of the insulator 13, and the insulator 13 is fitted into the recessed portion 51*d* of the anode 12.

Thereby, the insulator 13 is sandwiched by the cathode 11 and the anode 12, as shown in FIG. 3A, to form a pair of electrodes.

Figure 4:
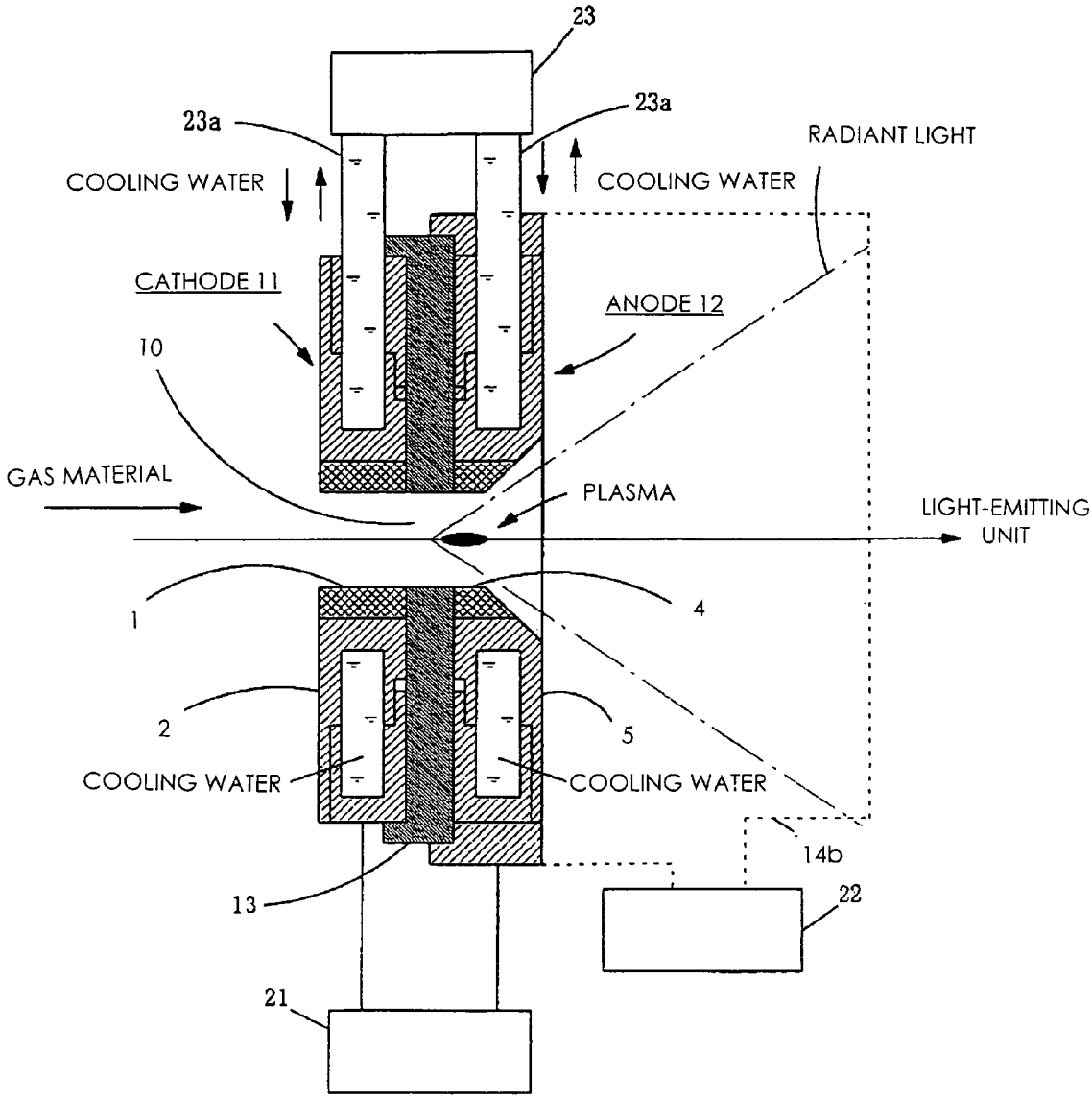
FIG. 4 is a schematic view showing an electrode section of an EUV radiation generator using the electrode portion according to the embodiment of the invention.

FIG. 4 is a schematic view showing an electrode section of an EUV radiation generator according to this embodiment.

As shown in FIG. 3A, the insulator 13 is sandwiched by the ring-shaped cathode 11 and the anode 12. The discharge portions 1 and 4, as mentioned above, are made of material having a high melting point (for example, tungsten), respectively, and the cooling portions 2 and 5 of the cathode 11 and the anode 12 are made of material having a high thermal conductivity (for example, copper), and the insulator 13 is made of, for example, ceramics.

A gas material for plasma discharge is supplied to a high temperature and high density plasma generating space 10 which is formed inside the ring of the cathode 11.

Figure 7:
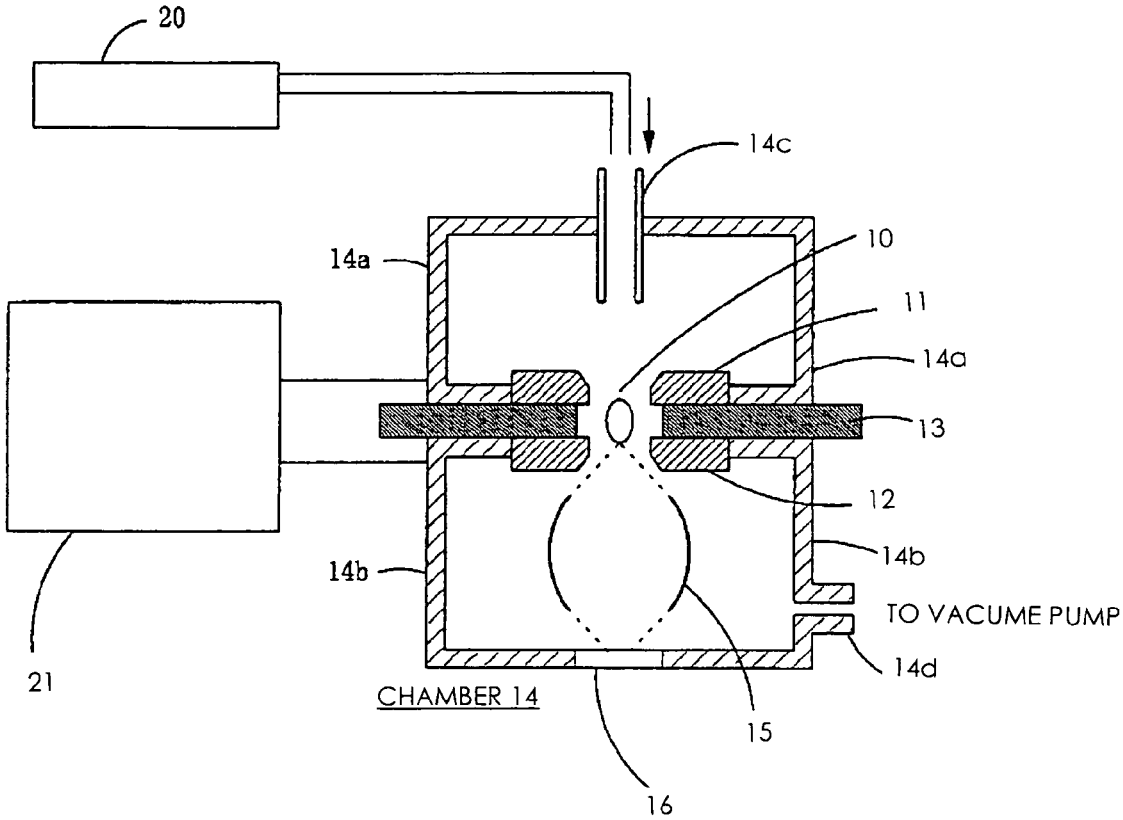
FIG. 7 is a view showing a schematic configuration of an EUV radiation source device.

A vacuum chamber (second container 14*b*), as shown in the FIG. 7, is attached to the anode 12 side, and the vacuum chamber is evacuated by a vacuum pump 22. Moreover, an optical system (not shown), such as a mirror, is provided within the vacuum chamber 14*b*.

The cooling portion 5 of the anode 12 is grounded, and a high voltage pulse generating unit 21 is connected between the cooling portion 2 of the cathode 11 and the cooling portion 5 of the anode 12, in which a pulsed breakdown voltage is applied to the cooling portion 2 of the cathode 11.

Since the outer walls of the discharge portions 1 and 4 are provided in close contact with the walls of the holes of the cooling portions 2 and 5 respectively, the discharge portion 1 and the cooling portion 2, and the discharge portion 4 and the cooling portion 5 have a good electrical-connection relation and a good heat-conduction relation, respectively.

Pipeline 23*a* from a cooling device 23 are connected to the cooling portion 2 of the cathode 11 and the cooling portion 5 of the anode 12, respectively, and a coolant (water in this embodiment) is supplied through the pipelines 23*a*. The supplied coolant circulates through the annular cooling water passages formed inside the ring-shaped cooling portions 2 and 5 to cool down the cathode 11 and the anode 12, respectively, and returns to the cooling device 23.

Next, the operation of the EUV radiation generator using the electrode according to this embodiment will be described below.

(i) When the discharge gas material is supplied inside the ring of the electrode 1 from the cathode side and a breakdown voltage is applied to the discharge portion 1 of the cathode 11 from the high voltage pulse generating unit 21, discharge is started between the discharge portion 1 of the cathode 11, and the discharge portion 4 of the anode 12, to generate plasma in the high temperature and high density plasma generating space 10 that is located inside the ring.

(ii) Meanwhile, cooling water is supplied to the cathode 11 and the anode 12 from the cooling device 23, respectively to cool down the cooling portions 2 and 5, the discharge portions 1 and 4, and the insulator 13.

(iii) The EUV radiation from the generated plasma is emitted toward the vacuum chamber 14*b*, and is led to a radiation-emitting unit by an optical system (not shown) provided in the chamber 14*b*.

(iv) Although the inner walls of the rings of the cathode 11 and the anode 12 become high in temperature by the generated plasma, since the discharge portion 1 and the discharge portion 4 are made of materials having high melting point such as tungsten, these portions do not melt easily.

(V) Moreover, since the cooling portions 2 and 5 in close contact with the discharge portions 1 and 4 respectively are made of the material having good thermal conductivity and are water-cooled, the discharge portions 1 and 4 are efficiently cooled down to prevent the temperature of the discharge portions 1 and 4 from becoming extremely high.

(vi) Although the insulator 13 sandwiched by the cathode 11 and the anode 12 has its inner wall exposed to high temperature by the plasma, since the insulator is sandwiched thereby and in contact with the liquid-cooled cooling portions 2 and 5 over large area, it is also cooled efficiently.

Next, other embodiments of the electrode portion will be described.

Figure 5:
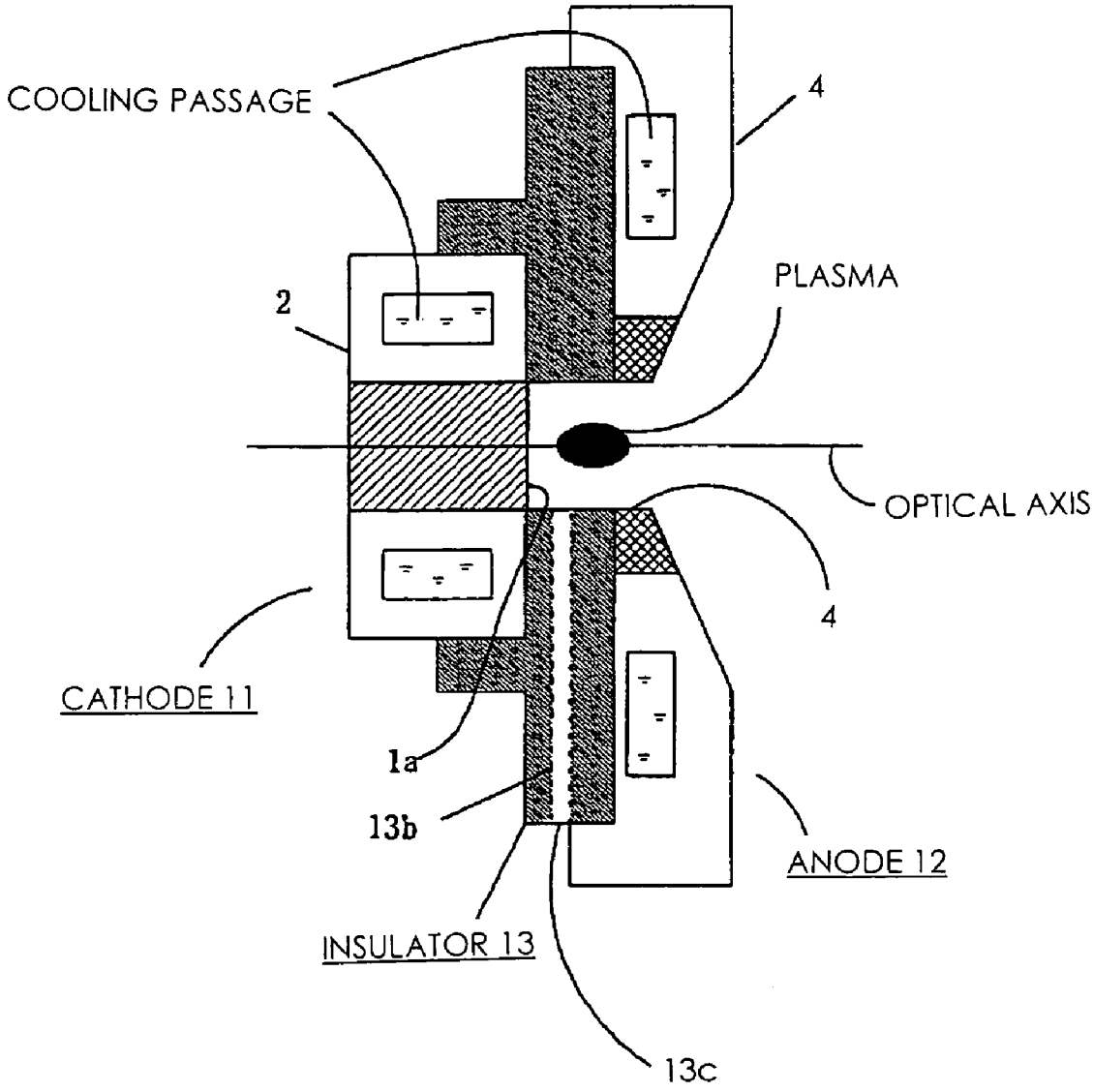
FIG. 5 is a view showing another exemplary configuration of the electrode unit according to another embodiment of the invention.
Figure 6:
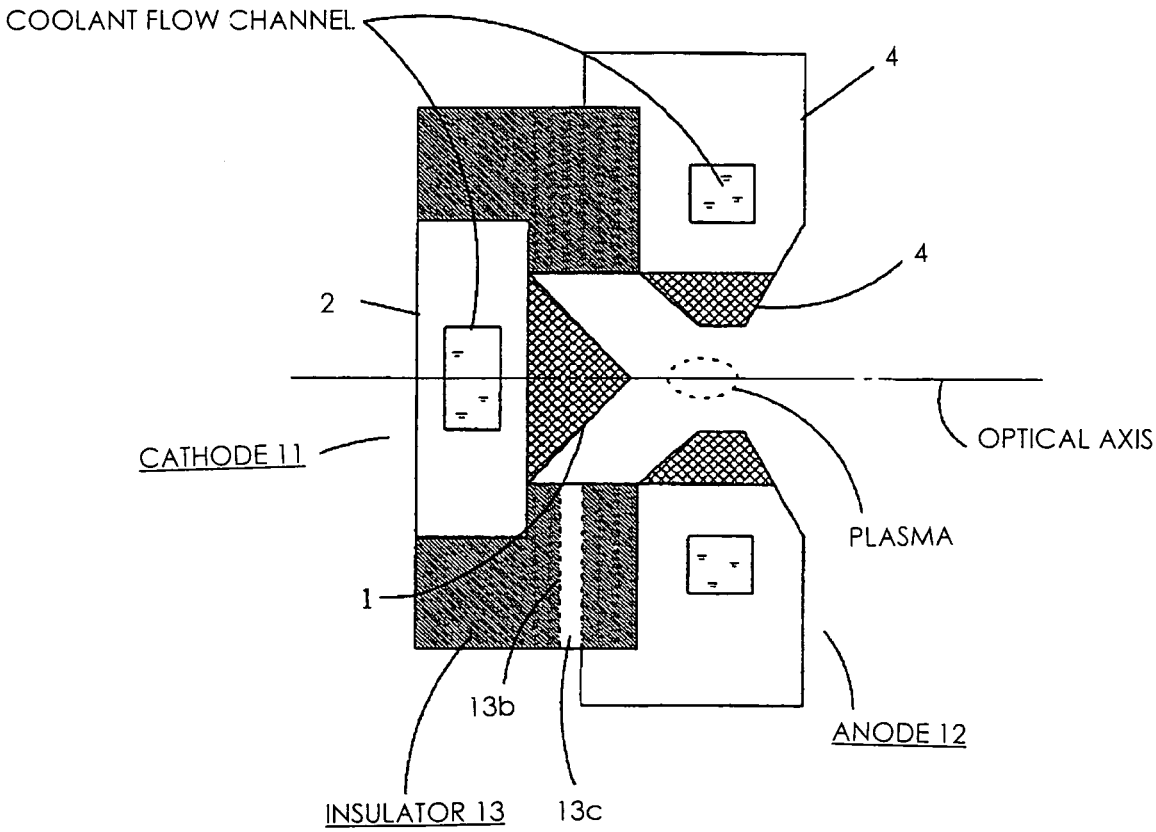
FIG. 6 is a view showing a still another exemplary configuration of the electrode unit according to still another embodiment of the invention.

FIGS. 5 and 6 are cross-sectional views of other embodiments of an electrode unit, taken alone a plane passing through the optical axes of the respective electrode.

In the above embodiment shown in FIGS. 1-4, although the discharge portion 1 of the cathode 11 is in a ring shape, it is also possible that the cathode is in a cylindrical shape as shown in FIG. 5 or a conical shape as shown in FIG. 6 as long as it has a structure, symmetrical with respect to the optical axis of light emitted from generated plasma.

FIG. 5 shows an electrode portion in which a cylindrical discharge portion 1*a* made of a solid high melting point material is brought into close contact with and attached to the through-hole of the ring-shaped cooling portion 2 of the cathode 11, and a flow passage 13*b* for supplying a plasma discharge gas material is provided in an insulator 13.

Discharge gas material is introduced into a space defined by the discharge portion 1*a*, the ring-shaped insulator 13, and the anode 12, through the flow passage 13*b* from a gas inlet 13*c*, and then high-voltage pulses are applied between the cathode 11 and the anode 12 to generate plasma inside the space.

FIG. 6 shows an electrode unit in which the cathode 11 is formed in the disc shape having a cooling water passage therein, a conical discharge portion formed from a high melting point material is brought into close contact with and attached to this disc-like cooling portion 2, and a flow passage 13*b* for supplying a plasma discharge gas material is provided in the insulator 13.

Discharge gas material is introduced into a space defined by the conical discharge portion 1, the ring-shaped insulator 13, and the anode 12, through the flow passage 13*b* from a gas inlet 13*c*, and then high-voltage pulses are applied between the cathode 11 and the anode 12 to generate plasma inside the space.

In addition, in FIGS. 5 and 6, only a portion (which faces the space where the plasma is generated) in the vicinity of a tip of the cylinder or the cone which forms the discharge portion 1 may be made of a high melting point material.

Also in the embodiments shown in FIGS. 5 and 6, as shown in FIG. 4, the cooling water is supplied to cooling water passages formed within the cooling portions 2 and 5 of the cathode 11 and the anode 12 from the cooling device 23, respectively so as to cool down the cooling portions 2 and 5 thereby cooling down the discharge portions 1 and 4 and the insulating material 13.

What is claimed is:

1. An electrode unit of an extreme ultraviolet radiation generator comprising:

a breakdown voltage impression electrode;

a ground electrode;

an insulator provided in contact with the breakdown voltage impression electrode and the ground electrode in which plasma is generated between the electrodes thereby emitting extreme ultraviolet radiation from the generated plasma, wherein at least one of the breakdown voltage impression electrode and the ground electrode includes a cooling portion which is made of copper, aluminum, or a material which contains copper, aluminum, or combination thereof as a main component and in which a passage through which a coolant passes is formed, and a discharge portion which is provided in close contact with a surface of the cooling portion, and which is made of any one of tungsten, tantalum, rhenium, molybdenum, and an alloy thereof as the a main component.

2. The electrode unit of an extreme ultraviolet radiation generator according to claim 1, wherein both of the ground electrode and the insulator have a ring shape, and are disposed on the same axis, and the discharge portion of the ground electrode has a ring shape, and is provided by bringing an outer wall of the ring-shaped discharge portion into close contact with an inner wall of the ring-shaped cooling portion of the ground electrode.

3. The electrode unit of an extreme ultraviolet radiation generator according to claim 1, wherein the cooling portion is formed by combining two or more members.

4. The electrode unit of an extreme ultraviolet radiation generator according to claim 2, wherein the cooling portion is formed by combining two or more members.

5. The electrode unit according to claim 1, wherein the electrodes are symmetric with respect to an optical axis of light emitted from the generated plasma.

6. The electrode unit according to claim 1, wherein the breakdown voltage impression electrode is in a cylindrical shape and provided on the coolant portion.

7. The electrode unit according to claim 6, wherein a flow passage is formed in the insulator.

8. The electrode unit according to claim 1, wherein the breakdown voltage impression electrode is in a conical shape and provided on the coolant portion.

9. The electrode unit according to claim 8, wherein a flow passage is formed in the insulator.

* * * * *